US005369924A

United States Patent [19]

Neudorf

[11] Patent Number: 5,369,924

[45] Date of Patent: Dec. 6, 1994

[54] STRUCTURAL CURTAINWALL SYSTEM AND COMPONENTS THEREFOR

[76] Inventor: Peter Neudorf, R.R. #1, St. Catharines Ontario, Canada

[21] Appl. No.: 56,295

[22] Filed: Apr. 30, 1993

[51] Int. Cl.[5] ..... E04B 2/88

[52] U.S. Cl. ..... 52/235; 52/200; 52/737.4; 52/730.6

[58] Field of Search ..... 52/200, 235, 204.57, 52/204.58, 488, 730.3, 730.4, 730.5, 730.6

[56] References Cited

U.S. PATENT DOCUMENTS

| | | | |
|---|---|---|---|
| 2,914,145 | 11/1959 | Benson | 52/235 |
| 3,830,029 | 8/1974 | Vance | 52/200 |
| 3,844,087 | 10/1974 | Schultz et al. | 52/200 |
| 4,114,330 | 9/1978 | Sukolics | 52/200 |
| 4,194,325 | 3/1980 | Chalpin, Jr. | 52/200 X |
| 4,387,542 | 6/1983 | Wehr | 52/235 X |
| 4,614,067 | 9/1986 | Matsubara | 52/200 X |
| 4,621,472 | 11/1986 | Kloke . | |
| 4,638,613 | 1/1987 | Tönsmann | 52/200 X |
| 4,650,702 | 3/1987 | Whitmyer | 52/235 X |
| 4,680,905 | 7/1987 | Rockar . | |
| 4,683,693 | 8/1987 | Rockar et al. | 52/235 X |
| 4,850,167 | 7/1989 | Beard et al. . | |
| 4,918,882 | 4/1990 | Funk . | |
| 4,996,809 | 3/1991 | Beard | 52/200 |
| 5,092,087 | 3/1992 | Kane et al. | 52/200 X |

*Primary Examiner*—Carl D. Friedman
*Assistant Examiner*—Kevin D. Wilkens
*Attorney, Agent, or Firm*—Hoffmann & Baron

[57] ABSTRACT

It is known in structural curtainwall systems to have a series of rafters and purlins supporting glass panes. It known also to provide drainage panels in the supporting elements to drain away any water which seeps past the external surfaces of the glass panes. In this invention, separate panels are formed comprising purlins and sub-frame members and supporting glass panes. These panels will be formed off-site in a factory. The sub-frames of the panels are received directly into channels in the rafters thus enhancing the resistance of the system to leakage particularly where the panels intersect the rafters. The joint between adjacent panels spanning the same pair of rafters is sealed by providing tongue members on the purlins which are resiliently deformable. The biasing of the tongue members provides a seal between adjacent panels. Furthermore, the tongue members form drainage channels to drain water into the drainage channels of the rafters.

32 Claims, 12 Drawing Sheets

STRUCTURAL CURTAINWALL SYSTEM AND COMPONENTS THEREFOR

FIELD OF INVENTION

The present invention relates generally to structural curtainwall systems. This invention includes skylight systems providing support members with internal drainage channels.

BACKGROUND OF THE INVENTION

Known curtainwall systems including known skylight systems typically include a series of generally parallel rafters attached to a series of purlins which are usually interconnected perpendicular to the rafters. The rafters and purlins provide a framework to support glass panes or panes made of other materials. Such a rafter and purlin structural framework is typically attached to the superstructure of a building.

U.S. Pat. No. 4,621,472 issued to Kloke shows such a framing system, wherein the glazing sheets are directly supported by both rafters and purlins. One of the major problems with skylight systems is providing a structure which will repel water. The glass panes are usually secured to the rafter and purlin framework in part by pressure plates which, when supplemented by gaskets or the like, provide a seal between the glass sheets and the plate. However, water can penetrate the seal. Kloke teaches the use of drainage channels in both rafters and purlins. Water which passes by the seals will enter drainage channels in the purlins and then be discharged into the drainage channels in the rafters and thereafter be removed from the structural system. Kloke also teaches the use of channels along the length of the purlins to trap condensation that collects on the inside of the glass panes and also provides for discharge into the drainage channels of the rafters. The system disclosed by Kloke shows an interconnection between the purlin and the rafter wherein an overlapping portion of the purlin is supported in a cut-out portion through the side of the rafter.

Other such structural systems which include similar drainage means are disclosed in U.S. Pat. No. 4,680,905 which issued to Rockar and U.S. Pat. No. 4,850,167 which issued to Beard et al.

However all these known systems utilize the same basic principle of providing a framework system to which the panes are secured in the field. In such systems the structural framework of rafters and purlins is first constructed in the field and then the panes are installed. Although a seal between purlins and panes is created by a pressure plate, this seal is sometimes not very effective and can leak. Also, the drainage channels in the purlins can overflow. Another drawback is that the seal at the interconnection between the purlins and rafters can sometimes fail or be ineffective. In a system where there is a cut-out in the supporting rafter to support the purlin, there is a particular vulnerability at the cut-out for a leak or overflow. Further, assembly in the field is time consuming.

The structural system of this invention seeks to overcome the drawbacks of the known systems.

SUMMARY OF THE INVENTION

According to one aspect of the present invention there is provided a structural curtainwall system comprising: at least two rafters, said rafters being orientated in spaced apart planar relation to each other, each of said rafters having a channel extending longitudinally along a length of said rafters; at least one panel comprising a pane having an externally directed surface, a first sub-frame and a second sub-frame arranged in a spaced apart planar relation, said first sub-frame and said second sub-frame supporting said pane, each of said first sub-frame and said second sub-frame having a flange means protruding therefrom, wherein said flange means of said first sub-frame is oriented and positioned so as to be adapted to be received within the channel of a first rafter of said at least two rafters and the flange means of said second sub-frame is oriented and positioned so as to be adapted to be received within the channel of a second rafter of said at least two rafters; means to secure said first and second sub-frames to said first and second rafters respectively, such that both said flange means may be received in said channels; whereby said panel may be mounted between said first rafter and said second rafter of said at least two rafters and any fluid passing over said externally directed surface of said pane to one of said first and second rafters is communicated into said channel of one of said first and second rafters.

According to another aspect of the present invention there is provided a structural curtainwall system comprising: first, second and third rafters, said rafters being orientated in spaced apart planar relation to each other, said first and third rafters having an open channel extending longitudinally along a length of said rafters, said second rafter having first and second open channels extending longitudinally along a length of said second rafter; first and second panels, each panel comprising a pane having an externally directed surface, a first sub-frame and a second sub-frame arranged in a spaced apart planar relation and at least one purlin member interconnecting said first and second sub-frames, said first sub-frame and said second sub-frame and said at least one purlin member supporting said pane, said first sub-frame and said second sub-frame having a flange means protruding therefrom, wherein said flange means of said first sub-frame of said first panel is oriented and positioned so as to be received within the open channel of said first rafter and the flange means of said second sub-frame of said first panel is oriented to be received within one of the first and second channels of said second rafter, and wherein the flange means of said first sub-frame of said second panel is oriented and positioned so as to be received within the other of said first and second channels of said second rafter and the flange means of said second sub-frame of said second panel is orientated and positioned to be received within the channel of said third rafter; means to secure each of said sub-frames to the respective rafters such that each said flange means may be received in the respective channels; whereby said first panel may be mounted between said first and second rafters and said second panel may be mounted between said second and third rafters, said panels being disposed on opposite sides across said second rafter, and any fluid passing over said externally directed surfaces of said panes of said panels is communicated to one or more of said channels of said rafters.

According to a further aspect of the present invention there is provided a curtainwall system comprising; at least two rafters being oriented in spaced apart planar relation to each other; first and second panels, said first and second panels each comprising first and second purlins, said purlins being disposed opposite one another and supporting between them a pane, said panels being adapted to be mounted between a pair of said rafters and said first panel being adapted to be mounted adjacent said second panel with said second purlin of said first panel mounted adjacent said first purlin of said second panel, and wherein both of second purlin of said first panel and said first purlin of said second panel have slot forming means to provide opposed facing slots each adapted to retain an edge of a gasket, whereby a fluid seal is provided between said adjacent first and second panels along the length of said second purlin of said first panel and said first purlin of said second panel.

According to a further aspect of the present invention there is provided a curtainwall system comprising: at least two rafters being oriented in spaced apart planar relation to each other; first and second panels, said first and second panels each comprising first and second purlins, said purlins being disposed opposite one another and supporting between them a pane, said panels being adapted to be mounted between a pair of said rafters and said first panel being adapted to be mounted adjacent said second panel, and wherein each of said first and second purlins of each of said first and second panels has tongue means extending outwardly the length thereof, said tongue means of the first purlin of said first panel adapted to engage the tongue means of a second purlin of said second adjacent panel to form a fluid resistant seal between said adjacent panels.

According to a further aspect of the present invention there is provided a panel for use with a pair of rafters, said pair of rafters being orientated in spaced apart planar relation to each other, each of said rafters having a channel extending longitudinally along a length of said rafters, said panel comprising a pane having an externally directed surface, a first sub-frame and a second sub-frame arranged in a spaced apart planar relation and at least one purlin means interconnecting said first sub-frame and said second sub-frame, said first sub-frame, said second sub-frame and said purlin means supporting said pane, each of said first sub-frame and said second sub-frame having a flange means protruding therefrom, wherein said flange means of said first sub-frame is oriented and positioned so as to be adapted to be received within the channel of one of said rafters and the flange means of said second sub-frame is oriented and positioned so as to be adapted to be received within the channel of another of said rafters, and further comprising a means to secure each said sub-frame to its respective rafter such that each flange means is received in said channels whereby said panel may be mounted between said pair of rafters and any fluid passing over said externally directed surface of said pane to one of said pair of rafters is communicated into said channel of one of said pair of rafters.

BRIEF DESCRIPTION OF THE DRAWINGS

The invention will be more clearly understood after reference to the following detailed specification read in conjunction with the drawings describing and illustrating example embodiments of the invention.

DESCRIPTION OF THE PREFERRED EMBODIMENTS

Figure 1:
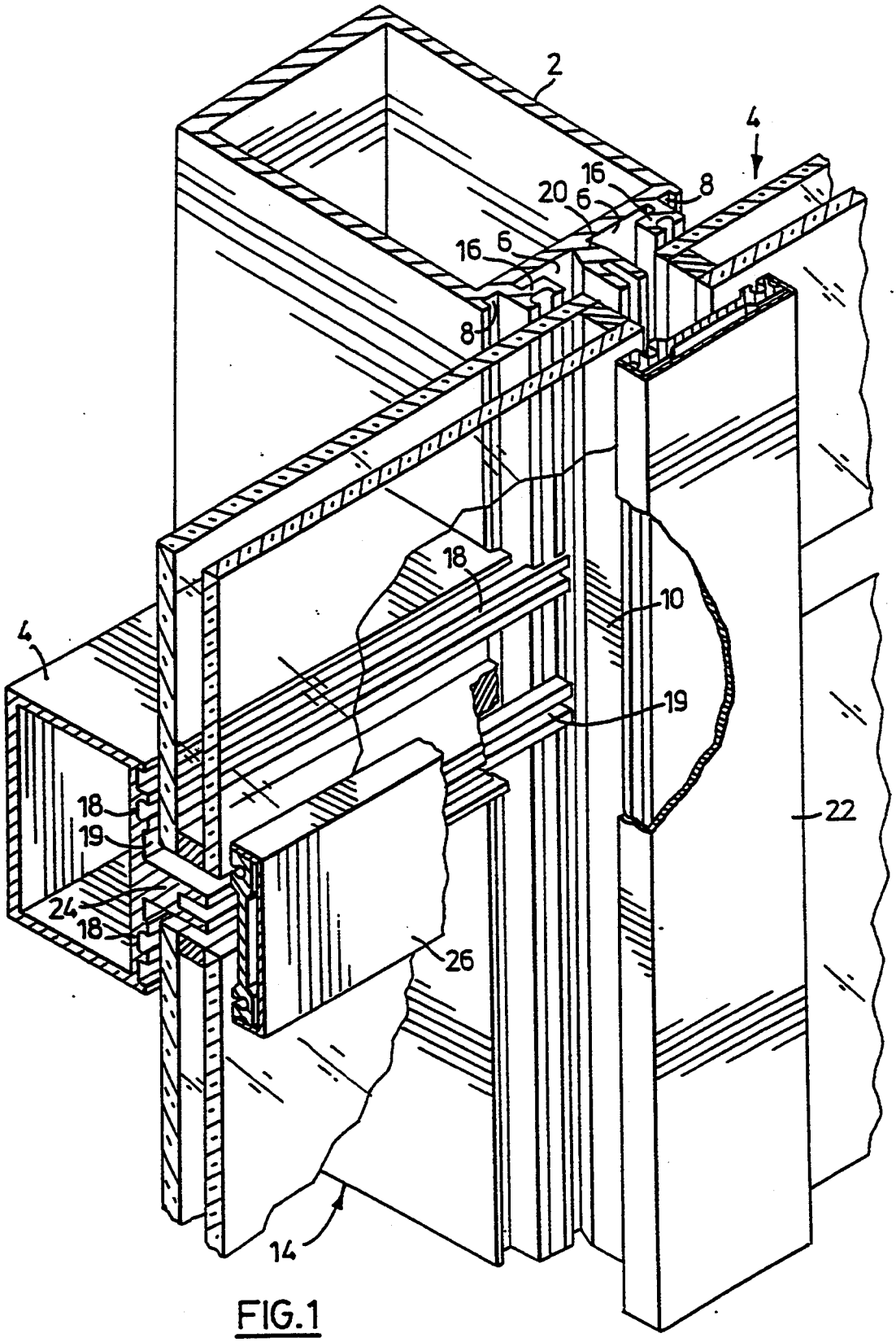
FIG.1 (PRIOR ART)
FIG. 1 is a perspective view, partially exposed, of a part of a typical prior art structural skylight system.

Referring initially to FIG. 1, a typical prior art structural skylight system is shown.

The prior art skylight system has tubular rafters 2 having drainage channels 6 and condensation channels 8. Double layered panes of glass, or other material, collectively shown as 14 are directly supported on longitudinal upstanding walls 16 of rafter 2 and upstanding wall 18 of tubular purlins 4. In this specification the term pane refers not only to single panes of glass or the like, but also includes double glazing, and other known curtainwall materials. At a cut-out portion of an upstanding wall 16, generally designated as 10, extension portions 19 of a purlin 4 are supported by rafter 2. Rafter 2 also has an upstanding anchoring channel 20 which is engaged by bolts or screws (not shown) which pass through pressure plate 22 securing the panes 14 in place. Similarly purlins 4 have upstanding channel members 24. Pressure plate 26 is anchored to channel 24 of purlin 4 and thus panes 14 are secured to purlins 4.

The pressure applied by pressure plates 22 and 26 creates a seal, although the seal may have a susceptibility to leak. Fluid leaking past the pressure plates' seals is intended to pass into channels 19 of purlins 4 and channels 6 of rafter 2, and thereafter discharged from rafter 2. However, these channels 19 and 6 can overflow. Also, the interconnection between the purlin and rafter at cut-out 10 is particularly susceptible to leaking.

Figure 2:
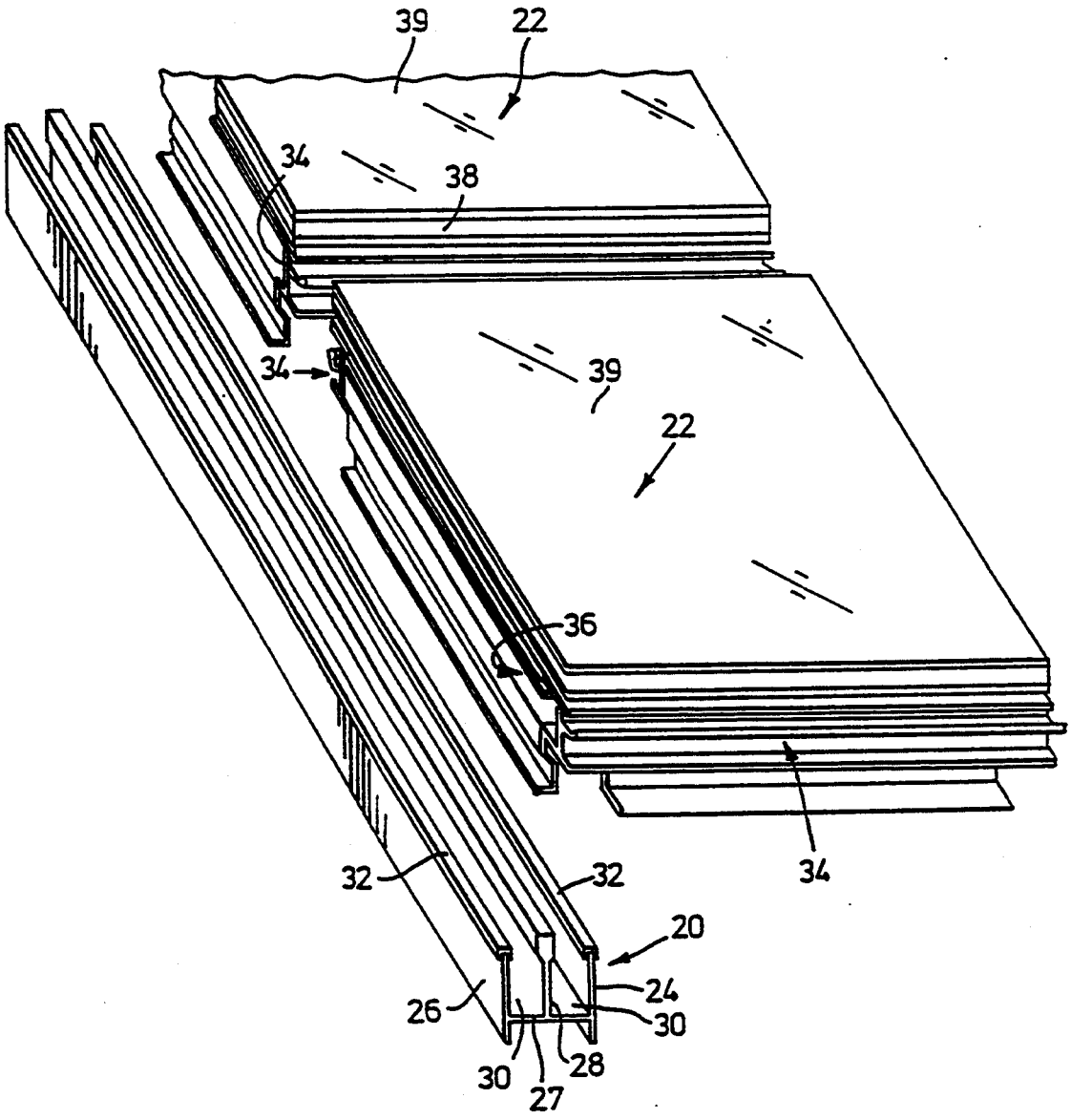
FIG. 2 is an exploded perspective view, showing part of a structural skylight system according to one embodiment of the invention.
Figure 2A:
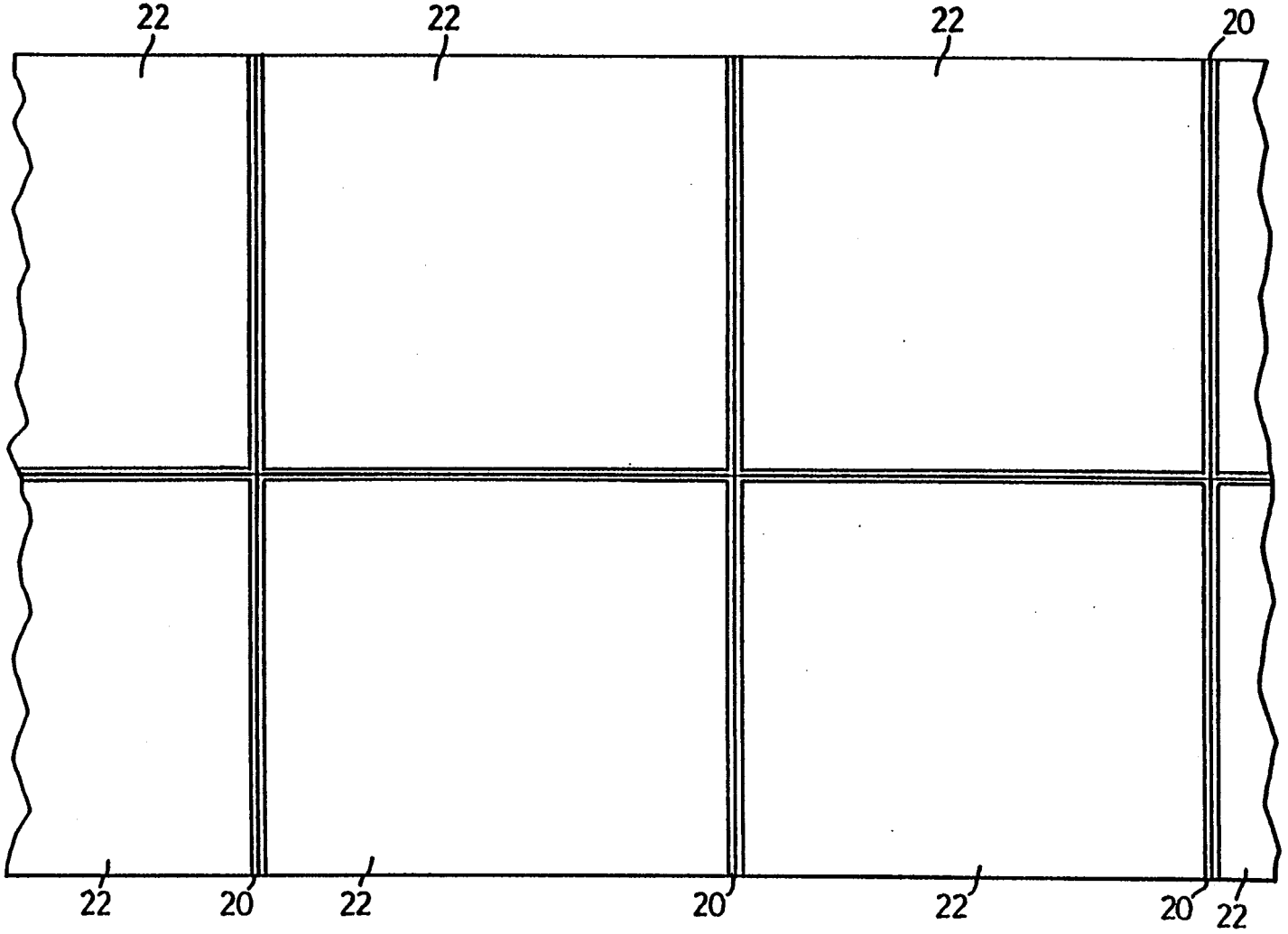
FIG. 2A is a schematic plan view of a structural skylight system according to one embodiment of the invention.

FIG. 2 shows part of a structural skylight system in accordance with one embodiment of the invention. Shown in FIG. 2 is a rafter 20 and panels 22. The structural skylight system may be disposed horizontally or at any angle to horizontal. In other words this system has application also as a vertical window glazing system as well although the problems associated with repelling fluid are enhanced in horizontally oriented systems. Rafter 20 has a pair of outer longitudinal walls 24, 26, and a base wall 27 and a centrally located longitudinal central wall 28 extending normal to the base wall 27. Walls 24, 26, and 28 form first and second channels 30 that extend longitudinally the length of the rafter. If necessary, the channels 30 can be canted to ensure that fluid will flow to one or both ends of the rafter to be removed from the structural skylight system. As shown schematically in FIG. 2A, a structural skylight system would have several rafters 20, typically oriented generally parallel to one another, and supporting a plurality of panels 22. Although not shown in FIG. 2A, the rafters are secured to supporting members, typically the columns in the superstructure of the building.

Rafters 20 are typically made of aluminum or an alloy thereof. Walls 24 and 26 have beads 32 preferably made from a resilient material such as neoprene running longitudinally along the upper edge thereof.

Panels 22 comprise a pair of purlins 34, preferably arranged in spaced parallel relation to one another. Each of the ends of purlins 34 are interconnected by conventional means to the ends of two sub-frames 36 also positioned in a generally parallel spaced apart relation to one another. Interconnection of two purlins 34 and two sub-frames 36 provides a generally rectangular panel framework to which is secured a pane 38 made of a suitable material such as glass, plastic, etc. Although the particular embodiment shown in the Figures relates to the specific application of skylight systems, panes 38 may be made of a non-transparent material such as metal or granite to provide another form of structural curtainwall system than a skylight system. Panes 38 have externally directed surfaces 39. Panes 38 are secured to purlins 34 and sub-frames 36 by a structurally glazed silicone material to form a panel 22.

Figure 3:
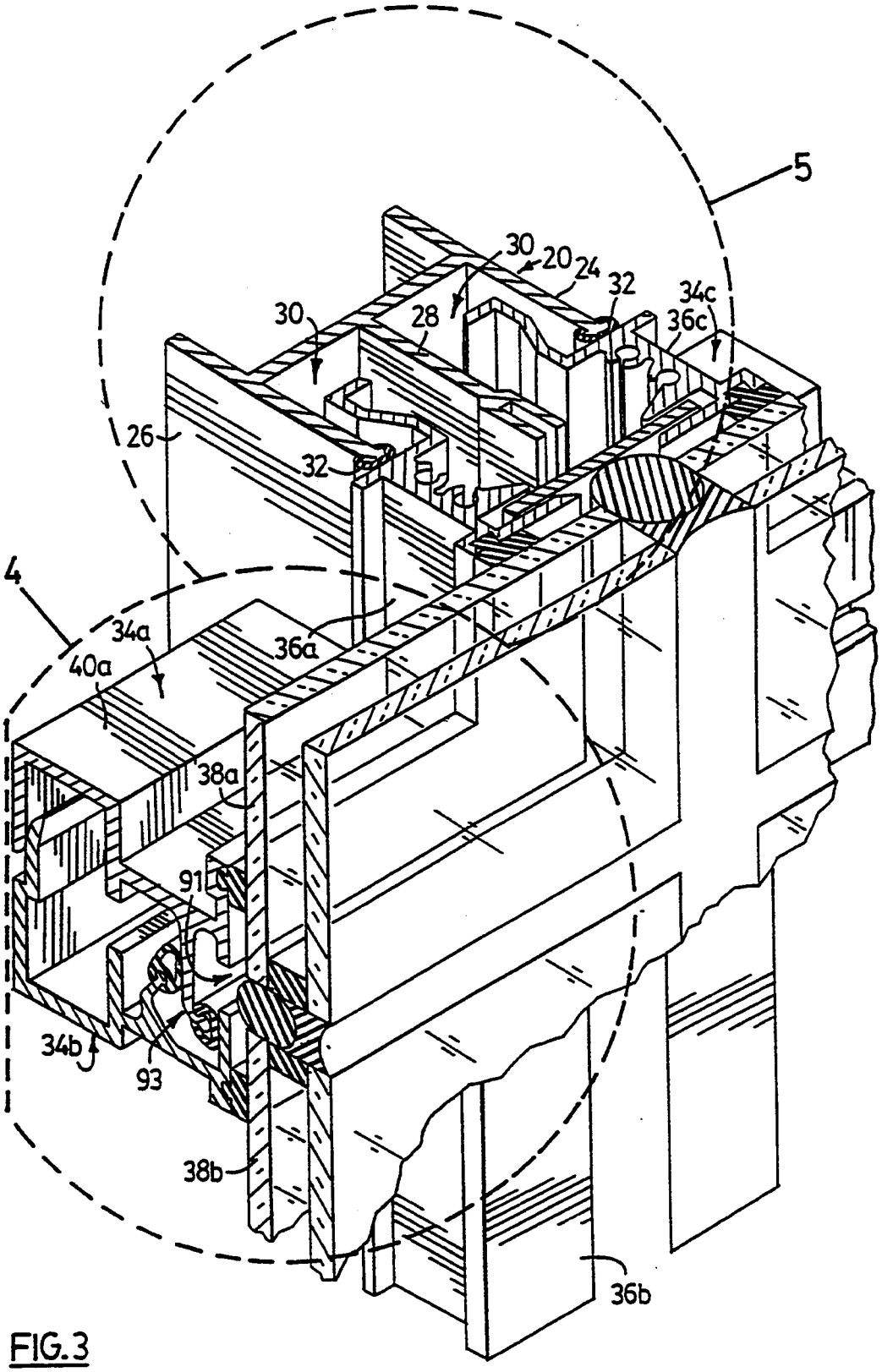
FIG. 3 is a perspective view of part of a structural skylight system according to one embodiment of this invention showing details of the interconnection between panels and a rafter and between adjacent panels.
Figure 4:
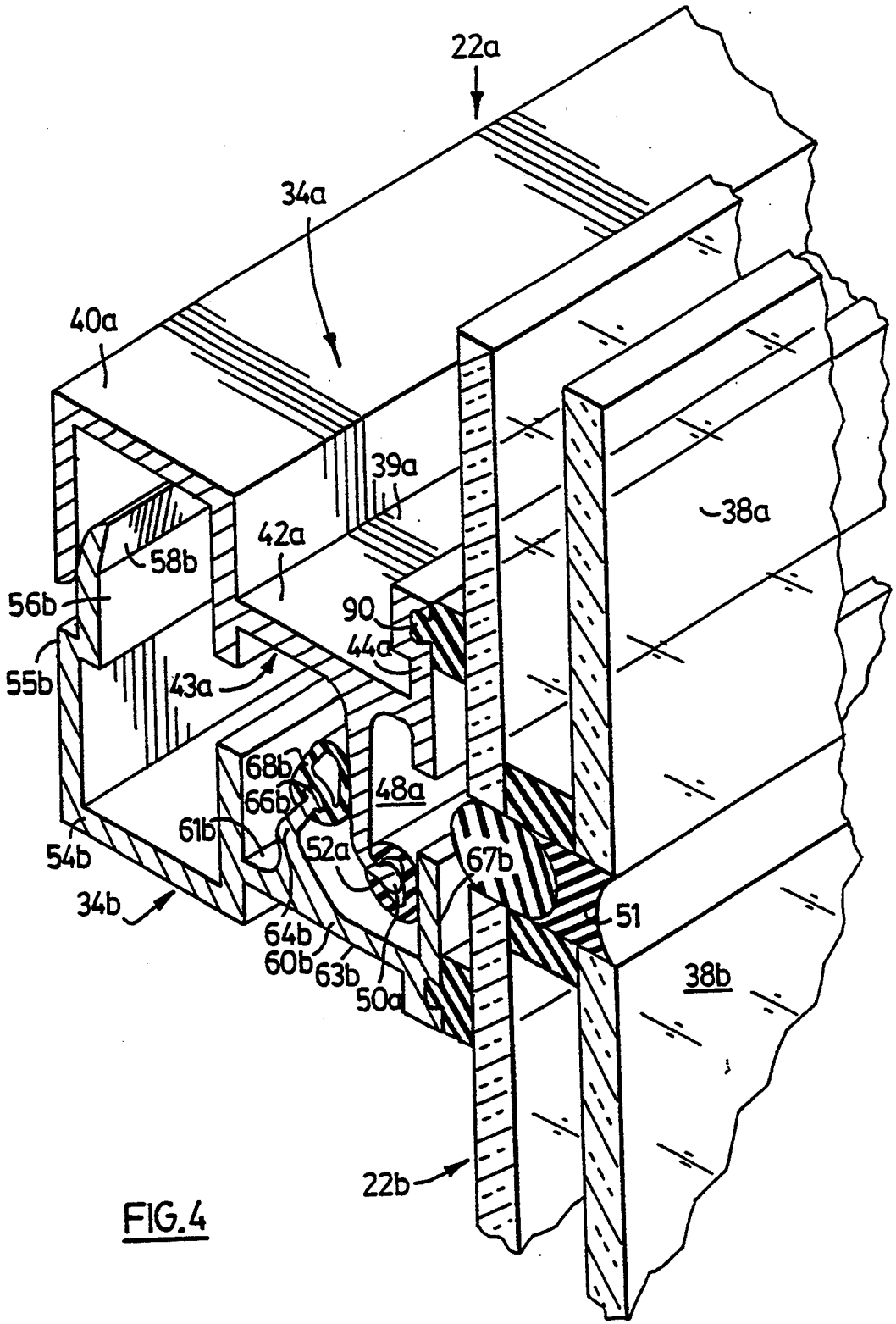
FIG. 4 is a detailed view of part of FIG. 3.

As shown in FIGS. 3 and 4, a purlin **34*a* of a first panel 22*a* has a generally C-shaped lower portion 40*a*, an upstanding integral wall member 42*a* and a top flange 44*a* extending normal to wall member 42*a* and which supports a pane assembly 38*a* by way of a dovetail joint. Between a pane 38*a* and a flange 44*a* is located a silicone tape 90** that provides a bond between the pane and the flange.

Wall member **42*a* has an inner panel face 39*a* and an outer panel face 43*a*. Protruding outwardly from the outer face 43*a* of upstanding wall 42*a* is a longitudinal tongue member 48*a*. Tongue member 48*a* has a longitudinal edge 50*a*, along the length of which is secured a resilient bead material 52*a*** preferably made from neoprene.

Purlin **34*b* of a second panel 22*b* also has a generally C-shaped lower portion 54*b*. Along the bottom edge 55*b* of C-portion 54*b* extends a longitudinal wall portion 56*b* having an inwardly angled end 58*b*. Purlin 34*b* also has an integral upstanding wall member 60*b* having an inner panel face 63*b* and outer panel face 61*b* and a top flange member 67*b* also adapted to support a pane 38*b*. Furthermore, purlin 34*b* has a longitudinal, resilient tongue member 64*b* protruding from outer face 61*b* having an edge 66*b* to which is secured along its length a bead 68*b*** also preferably made from neoprene.

Figure 5:
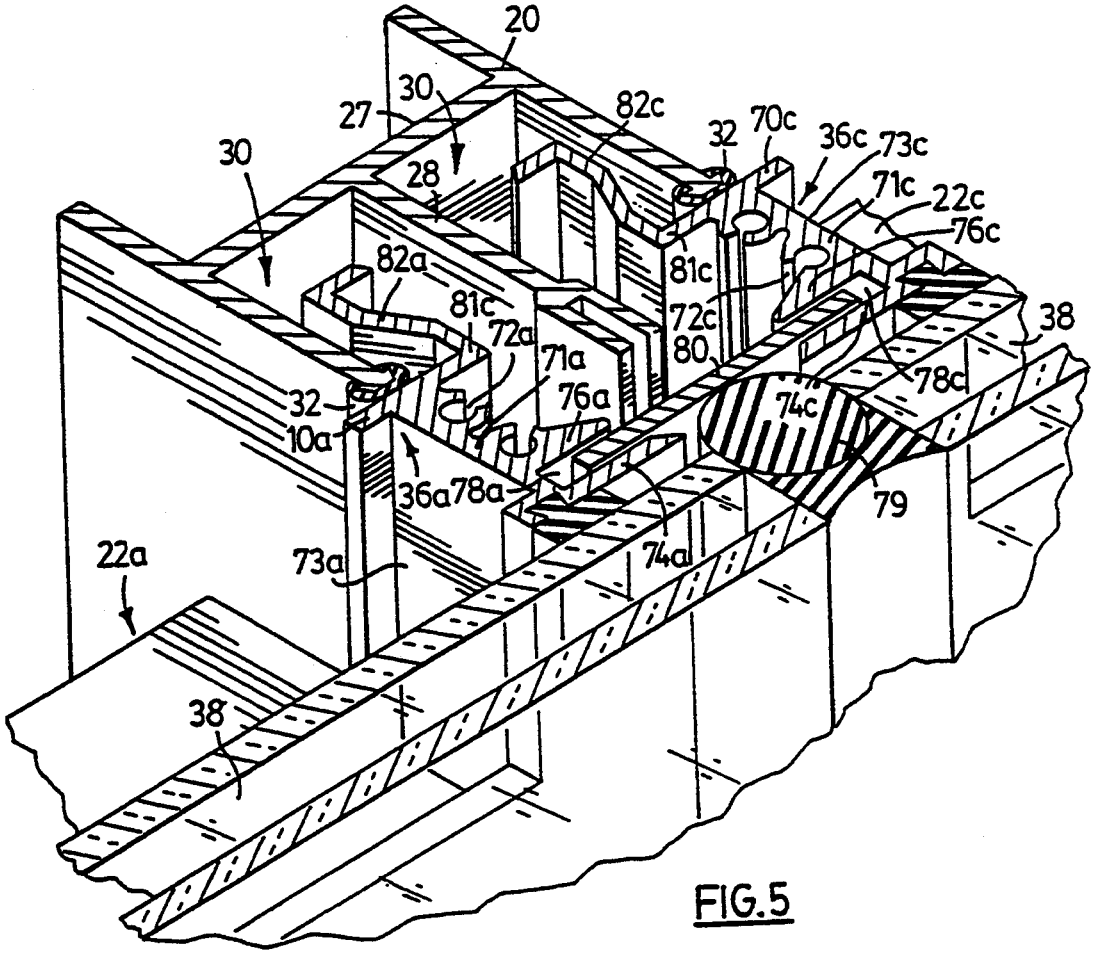
FIG. 5 is a detailed view of part of FIG. 3.

FIGS. 3 and 5 show sub-frames **36*a* and 36*c* having base plates 70*a*,70*c*, upstanding walls 71*a*, 71*c* having inner faces 72*a*,72*c* and outer faces 73*a*, 73*c*, top plates 74*a*, 74*c* and slot forming walls 76*a*, 76*c*. Top plates 74*a*, 74*c* and slot forming walls 76*a*, 76*c* generally extend normal to the upstanding walls 71*a*, 71*c* respectively and provide longitudinal openings or slots 78*a*, 78*c* in sub-frames 36*a* and 36*c* respectively, located between top plate 74*a* and slot forming wall 76*a* in sub-frame 36*a*, and between top plate 74*c* and slot forming wall 76*c* in sub-frame 36*c*. Slots 78*a*,78*b* are adapted to receive the marginal longitudinal edges of a pressure plate 80**.

Depending downwardly from outer edges **81*a*,81*c* of base plates 70*a*, 70*c* of sub-frames 36*a*, 36*c* are generally L-shaped longitudinal flange members 82*a*, 82*c***.

In this structural panel system, separate panels 22 are typically prefabricated off-site. The assembly of the panels in an off-site factory permits greater quality control and improves manufacturing efficiency. Once manufactured, panels 22 are brought to a site where a plurality of rafters 20 are arranged to accommodate the panels. Typically rafters 20 are arranged in longitudinally parallel-spaced relation to each other to accommodate generally rectangular panels 22.

The distance between a pair of rafters 20 and the distance between sub-frames 36 of a panel 22 correspond so that each of the sub-frames 36 of a single panel 22 extend between the channels 30 of the pair of rafters 20. As shown in FIG. 5, the base-plates **70*a*, 70*c* of sub-frames 36*a* and 36*c* rest on beads 32 of outer walls 24 and 26 of a rafter 20. L-shaped flanges 82*a*, 82*c* extend downwardly into a channel 30 of rafter 20 to restrict lateral movement of the sub-frames 36*a* and 36*c* relative to the rafter 20. In the embodiment shown in FIGS. 3 and 5 each of the flanges 82*a*,82*c* extends into a separate channel 30**. It will be appreciated that other variations are possible in that both flanges could be received within the same channel, having their respective base plates supported on opposite walls of the channel. This would however require a different mechanism for secure attachment of the panels to the rafter.

Figure 5A:
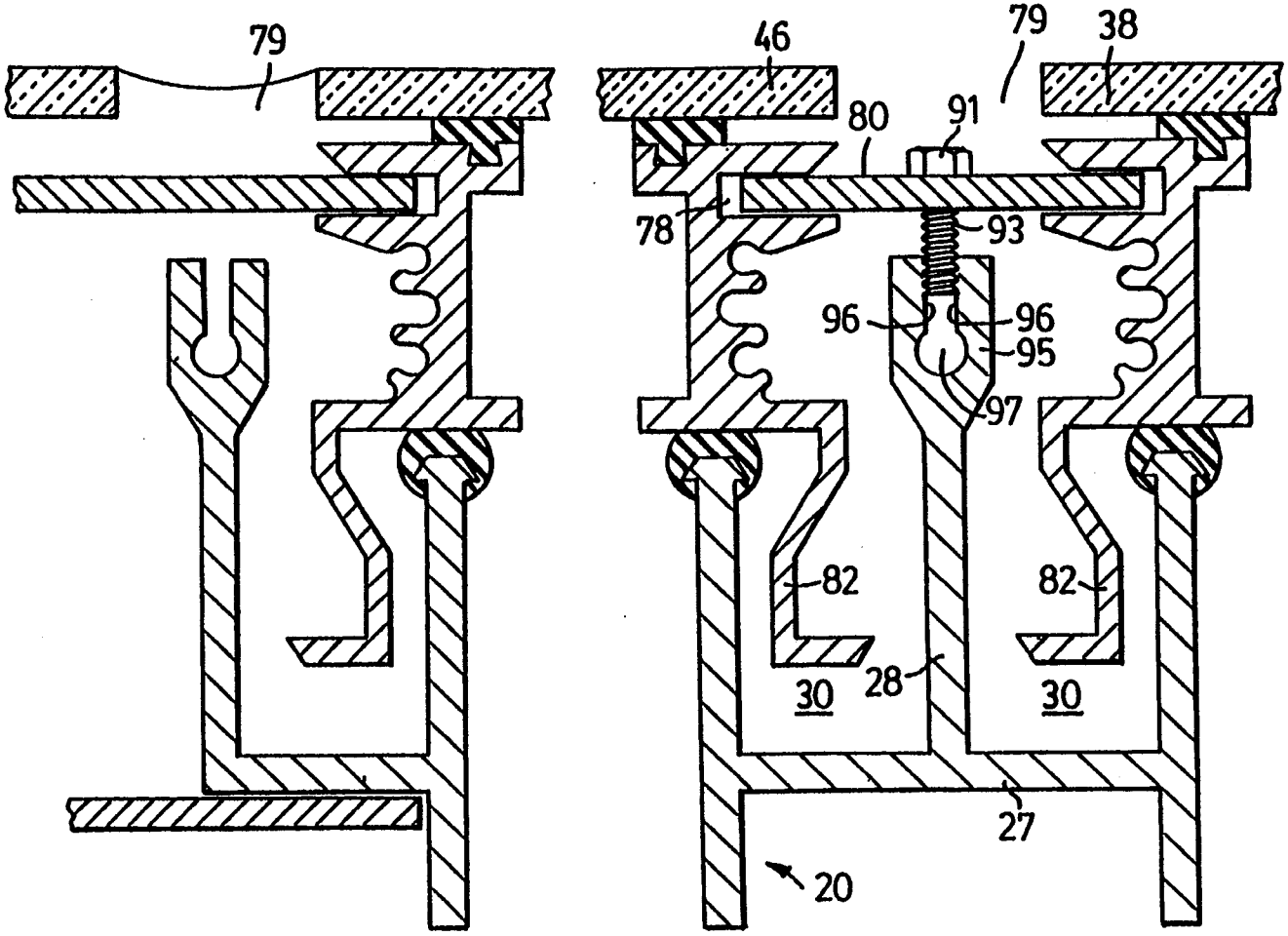
FIG. 5A is a sectional view of part of a skylight system according to one embodiment of this invention showing details of the attachment means of panels to a rafter.

As shown in FIG. 5A, this embodiment permits a pressure plate 80 to be secured to a rafter 20 by providing an attachment means such as a bolt 91 which has a shaft 93 passing through pressure plate 80 and mating with the elongated head 95 of the central wall 28. Elongated head 95 of wall 28 has a longitudinal channel 97 extending along its length, the side walls 96 of which are grooved longitudinally to receive shaft 93 anywhere along the length of channel 97. The engagement of bolt 91 with the walls 96 of channel 97 will result on pressure being exerted on both slot walls 76. Thus a fluid seal is created in slot 78. However, if fluid passes over the externally directed surfaces of panes 46 through the seal created in slot 78, fluid will seep into channels 30 and be carried away. A secondary seal is created by the pressure of base plate 70 which is exerted on bead 32 of outer walls 24 and 26. As the sub-frame members 36 are continuous along the length of the panel, there is no disruption in the wall 24 and wall 26 of channel 30, thus reducing the opportunity for leakage. The whole length of the flanges 82 of sub-frames **36*a*,36*c* rests in the channels 30**.

Typically a seal 79 of silicone or some other similar material will be provided between adjacent panes of adjacent panels such as panels **22*a* and 22*c* located on opposite sides of a rafter 20**.

FIG. 4 shows the interconnection between two adjacent panels **22*a* and 22*b* located on the same sides of rafters 20, each of the panels 22*a*, 22*b* typically having their sub-frames 36*a* and 36*b* resting in the same channel 30 of the rafter 20. The resilient tongue member 48*a* of purlin 34*a* abuts the top plate 67*b* of purlin 34*b* along its entire length. When in the position shown in FIG. 4, tongue member 48*a* has been displaced from its undeformed position, and is therefore biased against top plate 67*b*. Thus a first seal is provided between bead 52*a* and top plate 67*b*. Tongue member 64*b* has a bead 68*b* which engages the underside of tongue member 48*a* of purlin 34*a* along the length thereof, and likewise is biased against the tongue 48***a*, thereby creating a second fluid seal.

A third seal may also be formed at the contact between the lower edge of C-shaped portion 40*a* of purlin 34*a* and the inwardly extending angled section 58*b* of purlin 34*b*.

When two adjacent panels 22*a* and 22*b* having panes 38*a*, 38*b* are interconnected adjacent one another as shown in FIG. 4, the two panes 38*a* and 38*b* will typically be positioned close to one another and a seal 51 of silicone or other such material may also be provided therebetween. If fluid leaks past the silicone seal 51, the seal provided by bead 52*a* and top plate 67*b* will prevent or inhibit substantially water passing. The channel 91 formed by the tongue 48*a* is canted so that water will discharge along its length into a channel 30 of a rafter 20. A further channel 93 is provided for fluid which passes the seal created by bead 52*a* and top plate 67*b* and likewise channel 93 is canted so that fluid will flow and be deposited in channel 30 of a rafter 20. Channels 91 and 93 can if desired be canted along their entire length in one direction or a portion of the channel can be canted toward one end of a purlin, with the remaining portion of the channel being canted toward the other end of the same purlin.

It will be appreciated that because panels 22 are prefabricated in a rigid form, there is no requirement for a pressure plate to secure the panes 38 to purlins 34.

Figure 6:
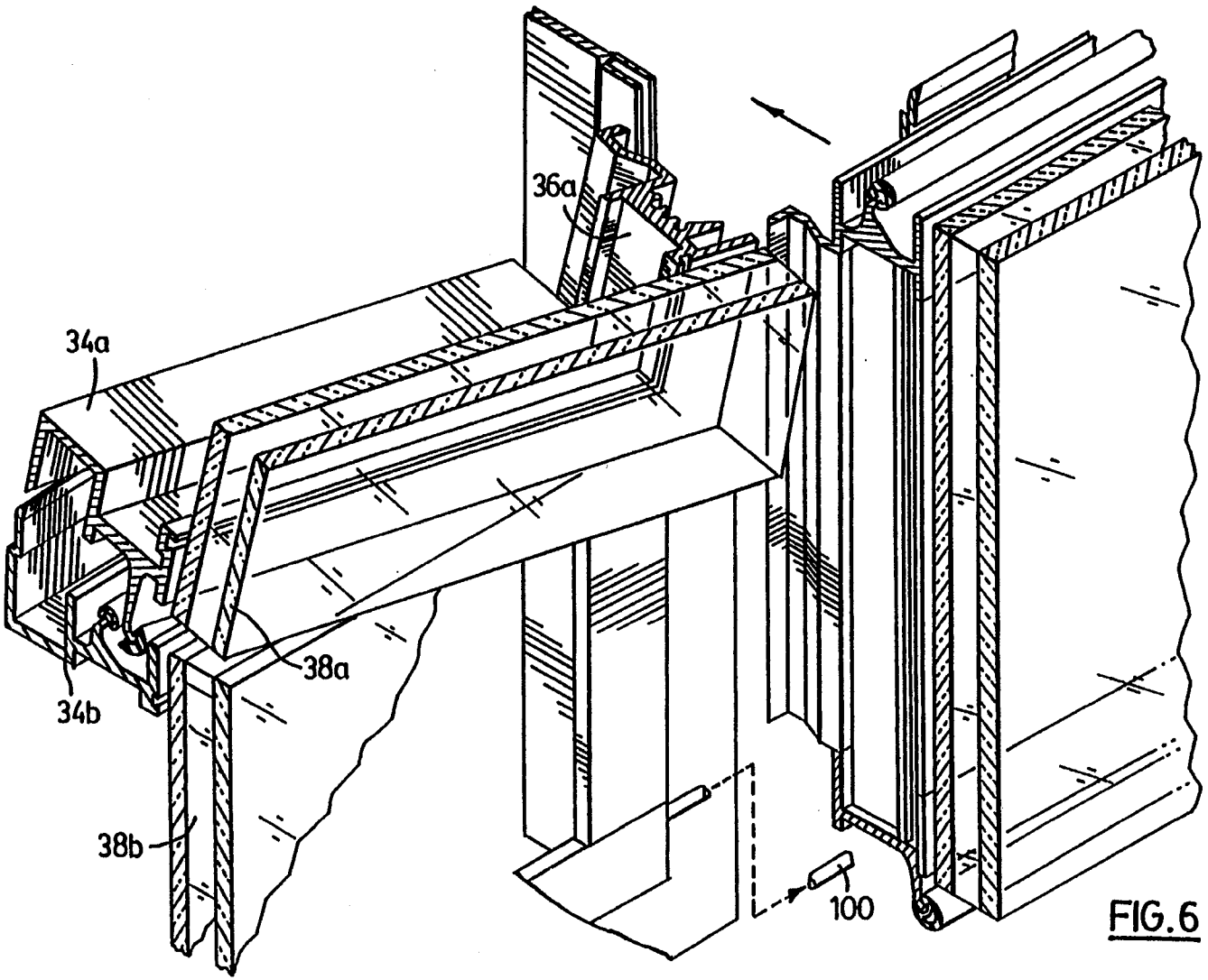
FIG. 6 is a perspective view of part of a structural skylight system in accordance with one embodiment of this invention, showing the positioning of one panel as it is secured to an adjacent panel and to a rafter.

FIG. 6 shows how a purlin 34 and a sub-frame member 36 of a panel 22 are positioned for interconnection with rafter 20 and an adjacent panel 22. A panel 22 is placed onto a rafter 22 by engaging the corners of the sub-frame, which is supported by a steel shaft or clip 100. Steel support clip 100 is structurally attached to a rafter and provides load support to resist the sideways movement of a panel along the channel of a rafter.

Figure 8:
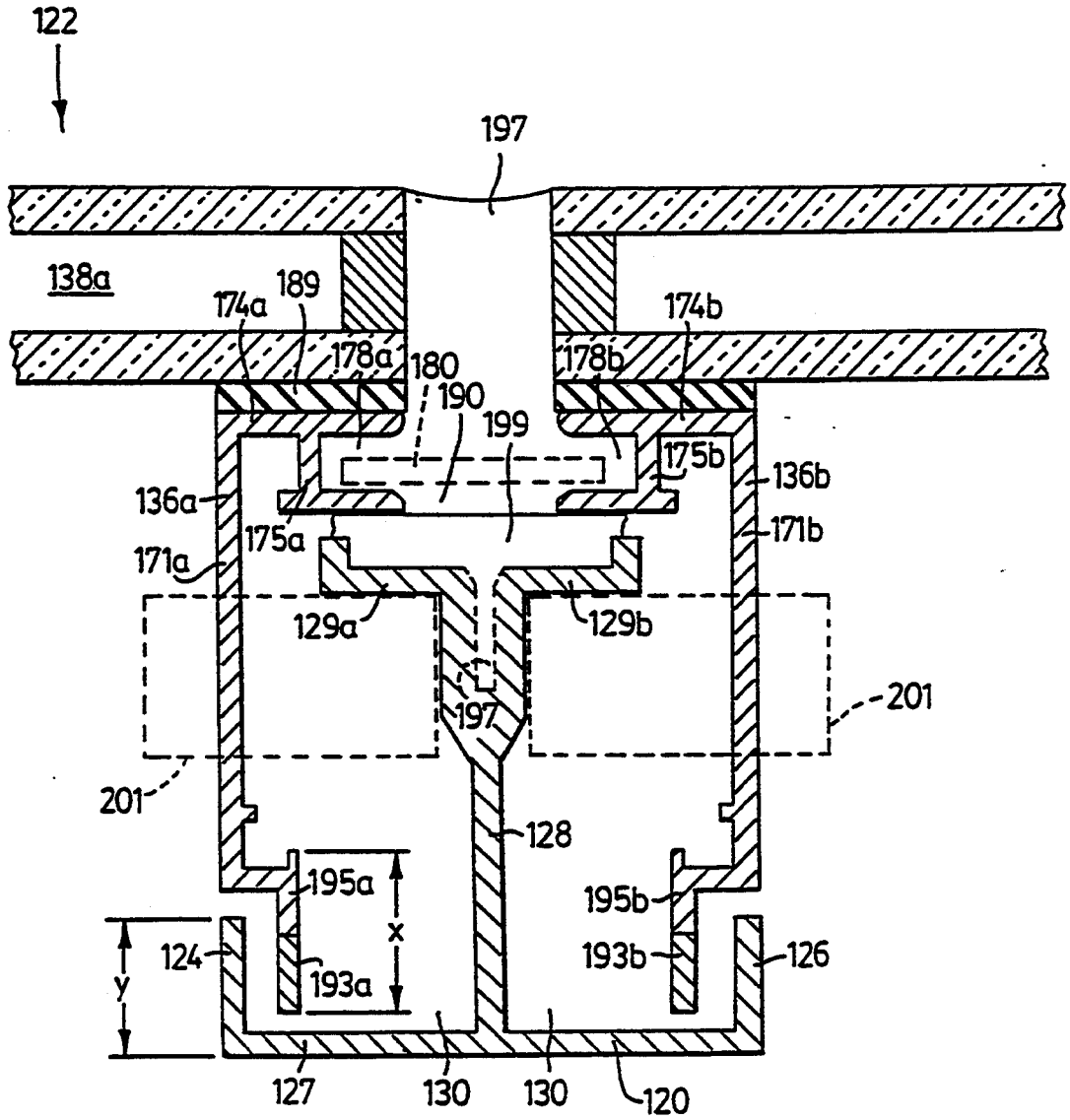
FIG. 8 is a sectional view of part of the skylight system shown in FIG. 7.
Figure 9:
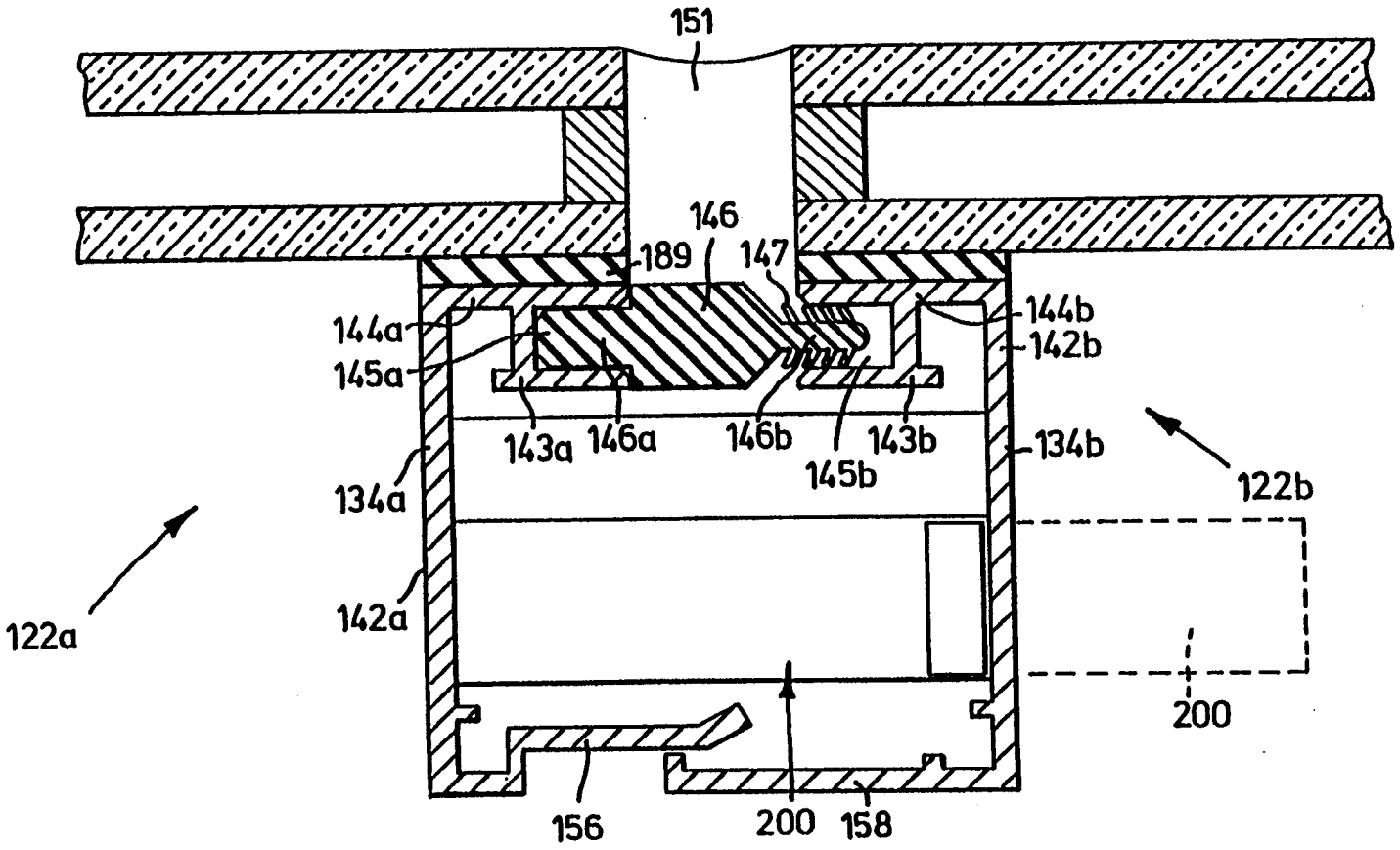
FIG. 9 is a sectional view of another part of the skylight system shown in FIG. 7.
Figure 10:
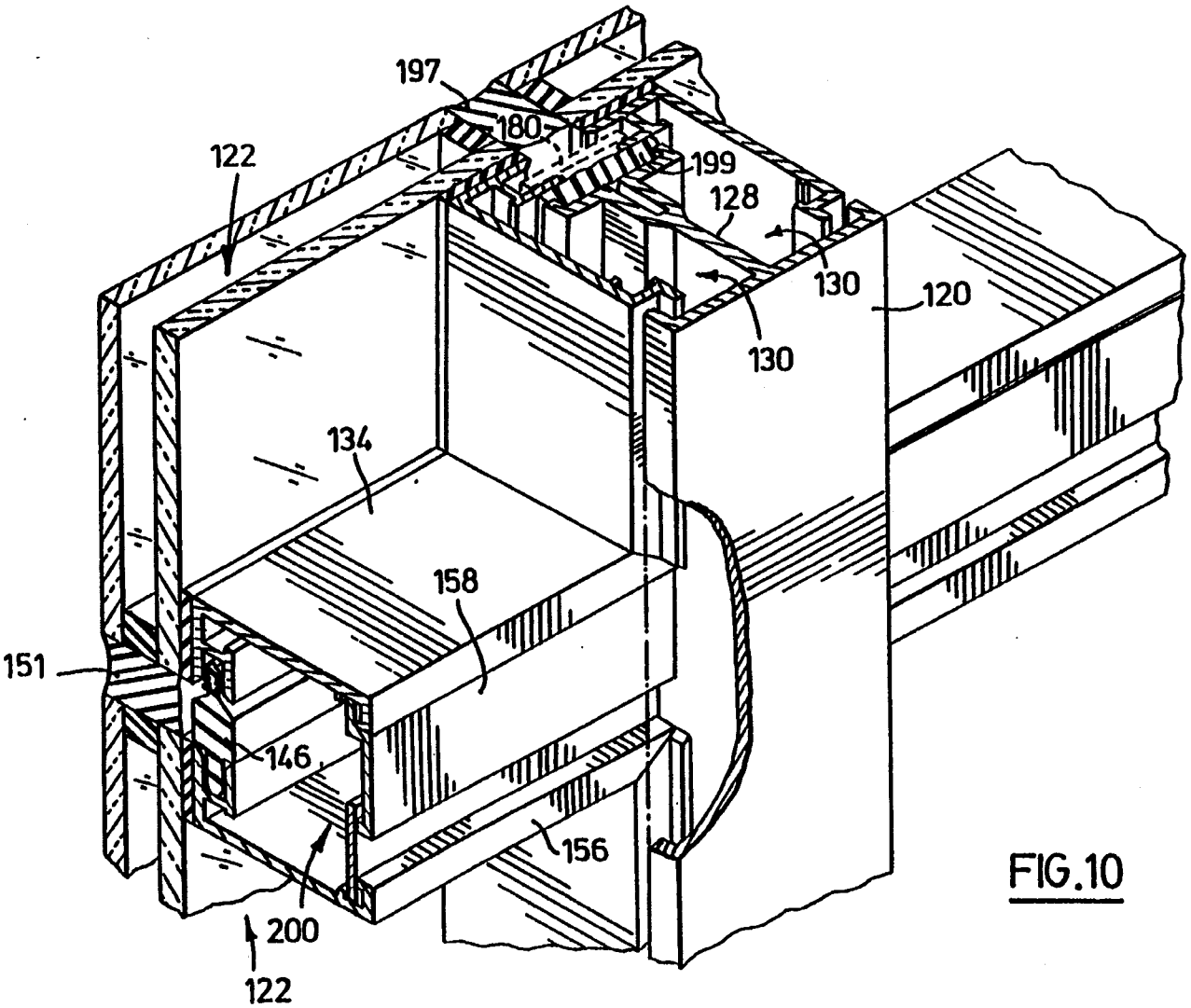
FIG. 10 is a perspective view from below, with part exposed, of part of the structural skylight system of FIG. 7 but incorporating variations therefrom.

Turning to FIGS. 7–10, shown are views of part of a skylight system in accordance with a different embodiment of the present invention. Each panel 122 is completely fabricated in a factory and comprises a pair of purlins 134, again arranged in spaced apart parallel relationship. Each of the purlins is interconnected to a pair of sub-frames 136 also arranged in spaced apart planar relation. As shown in FIG. 10, purlins 134 are mitre jointed at the intersection with the sub-frame members and would be MIG welded thereto. Purlins 134 and sub-frames 136 support the panes 138.

With reference to FIG. 8, a rafter 120 is shown supporting panes 138*a*,138*b*. Rafter 120 has longitudinal walls 124, 126 a base wall 127 and a centrally located longitudinal wall 128 forming channels 130. At its upper end, wall 128 has a pair of arms 129*a* and 129*b* oriented normally to wall 128 and divided by a longitudinal channel 197. Channel 197 is as described above, being grooved longitudinally along its length to receive the shaft of a bolt (not shown). The arms 129*a* and 129*b* are shaped to provide a recess to retain and support a gasket 199 typically made from neoprene or another suitable material.

Sub-frame 136*a*, 136*b* have, respectively, upstanding walls 171*a*, 171*b*, top plates 174*a*,174*b*, L-shaped flange members 175*a*, 175*b* depending from their respective top plates and forming slots 178*a*, 178*b* to receive the marginal longitudinal edge of a pressure plate 180.

Flange members 175*a* and 175*b* rest on gasket 199, thereby compressing gasket 199. A shaft of a bolt (not shown) passes through pressure plate 180 and gasket 199 and the shaft is securely received in grooved channel 197. The load exerted by panels 122 is transferred to the wall 128 of the rafter through the gasket. An air tight seal is thereby created between the flange members 175*a*,175*b* and arms 129*a*, 129*b*. When panels 122 are field placed in dry conditions on the vertical rafters, automatically a virtually 100% air and fluid seal is formed. This is an advantageous feature when installing curtainwall systems in the field. Furthermore, this seal will not be affected or broken by thermal or structural movement of the components.

In addition to the seal provided at gasket 199, a fluid seal is created by the pressure plate 180 in slot 178*a* and slot 178*b*. Furthermore, an external seal 197 is also provided by a silicone sealant. Should any fluid possibly pass by these three seals (which is unlikely) it would be captured in the channels 130. Any moisture trapped between the pressure plate seal and the gasket 199 in longitudinal gap 190 will in most applications be discharged from the structural system at the ends of the rafters.

In the embodiment shown in FIG. 8 walls 171*a* and 171*b* both have lower flanges 195*a* and 195*b* respectively with downwardly depending elements 193*a*,193*b* that extend into channels 130. Typical proportions of the length "y" of wall 124 to the length "x" of element 193*a* is 1 to $\frac{7}{8}$. It should be noted that flanges 195*a* and 195*b* do not rest on walls 124, 126 in this embodiment.

FIG. 9 shows the interconnection between adjacent purlins 134*a*, 134*b* of panels 122*a*, 122*b* respectively. In this embodiment each purlin has upstanding wall members 142*a*,142*b* a top plate 144*a*,144*b* and L-shaped flanges 143*a*,143*b*. Top plates 144*a*,144*b* and flanges 143*a*,143*b* form open slots 145*a*,145*b*. Panels 122*a* and 122*b* are bonded to top plates 144*a*,144*b* (as they also are to top plates 174) by a structurally glazed silicone seal 189.

Slot 145*b* has secured therein a first marginal edge 146*a* of a gasket 146 that extends the length of the slot 145*a*. This edge 146*a* may be permanently bonded into slot 145*a* of the purlin 134*a* in the factory during fabrication of the panel. The second marginal edge 146*b* of gasket 146 has a plurality of resilient protruding elements 147 which permit second end 146*b* to mate and to be inserted into slot 145*b* of purlin 134*b*. This creates an air and fluid seal between purlins 134*a* and 134*b*.

Figure 7:
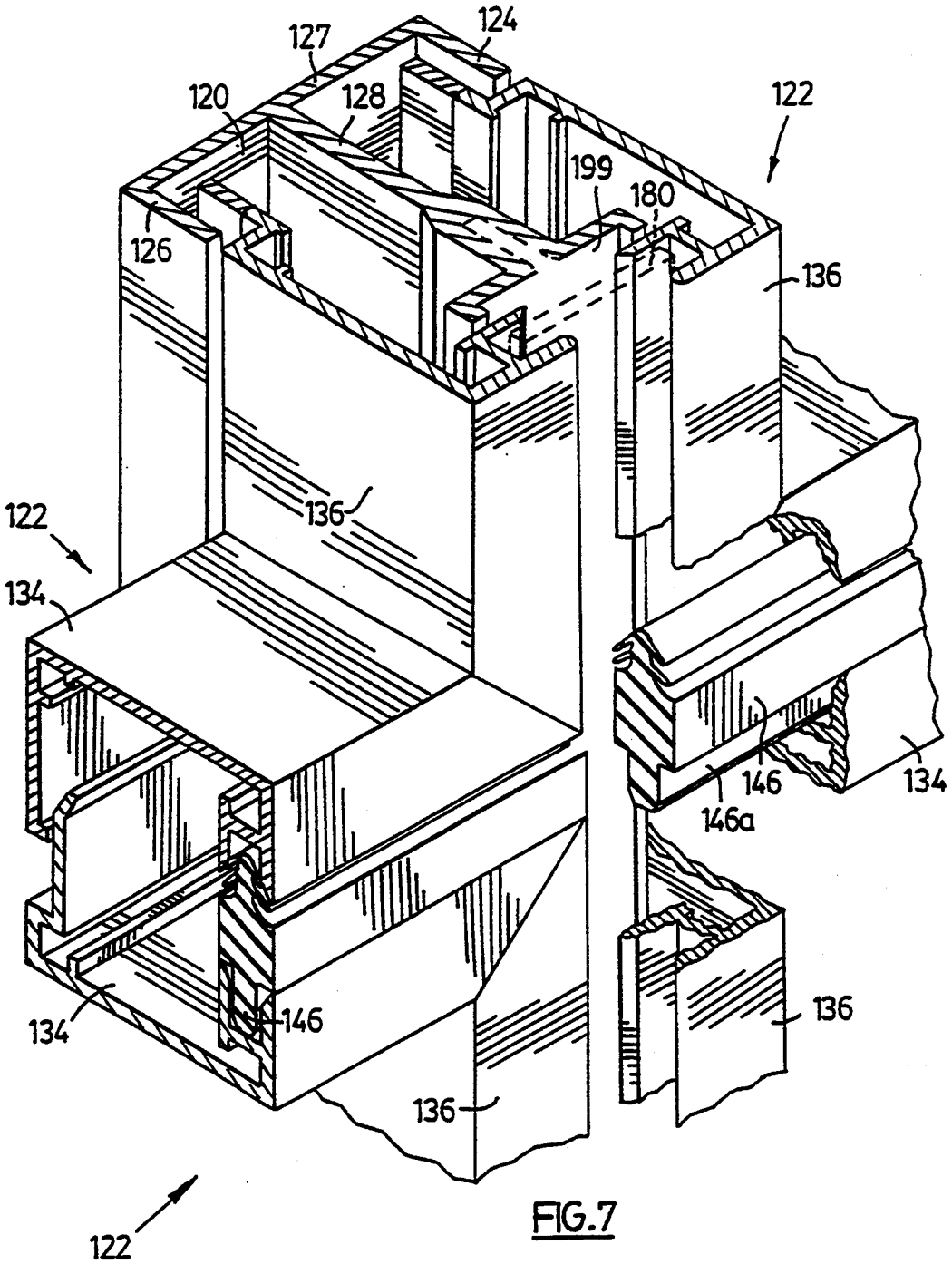
FIG. 7 is a perspective view from above, with part broken away, of part of a structural skylight system in accordance with another embodiment of the invention.

The intersection between gasket 146 and sub-frame 136 is shown in the exposed portion of FIG. 7. The end of gasket 146 abuts the edge of pressure plate 180. Although this might in some circumstances be a weak spot in the seal, in practice it is not likely to pose a significant problem. However, if leakage is a concern, then a further seal can be provided at the lower abutment of longitudinal wall portions 156 and 158 shown in FIG. 9. This would result in the creation of a channel 200 between the adjacent purlins 134*a*,134*b* and thus fluid passing into the channel 200 would be communicated into channel 130 of the rafter. Although in FIG. 10 the longitudinal wall portions 156,158 of the purlins are shown as being separate components from the rest of the purlin, in most cases the wall portions 156,158 would be integrally formed with the rest of the purlin as shown in FIG. 9.

An external seal 151 of silicone or a similar material is also provided above gasket 146 to provide an outer fluid seal. The gasket 146 will maintain an air and fluid seal even where there are thermal or structurally induced movements of the components. Thus a more durable and long lasting seal is provided by utilizing gasket 146 between the purlins (The same is true of the gasket 199 between the sub-frame members).

Also shown in FIGS. 8 and 9 are glass frame support brackets 200 and 201. These brackets are secured to the rafter and provide structural support for the panels 122.

Many other variations within the scope of the invention are contemplated. For example, a panel may in certain applications not have require any purlin members, and the pane may be supported on the rafters by the sub-frame elements 136. Such an application may result where only one panel is required to span a short distance between two rafters and in such an embodiment, a different sealing means might be provided along the sides of the panel that span the support rafters. Different configurations of rafters and shapes of panels are also possible.

I claim:

1. A structural curtainwall system comprising:

a. at least two rafters, said rafters being orientated in spaced apart relation to each other, each of said rafters having a channel extending longitudinally along a length of said rafters;

b. at least one panel comprising a pane having a weight and having an externally directed surface, an elongated first sub-frame and an elongated second sub-frame arranged in a spaced apart relation, each of said first sub-frame and said second sub-frame having a flange means protruding therefrom, wherein said flange means of said first sub-frame is oriented and positioned so as to be adapted to be received within the channel of a first rafter of said at least two rafters and the flange means of said second sub-frame is oriented and positioned so as to be adapted to be received within the channel of a second rafter of said at least two rafters said panel further comprising at least one purlin means connected to said first sub-frame and said second sub-frame, said first sub-frame, said second sub-frame and said purlin means supporting said pane;

c. means to secure said first and second sub-frames to said first and second rafters respectively, such that both said flange means are received in said channels;

said first and second rafters being positioned to support said first and second sub-frames, respectively such that when said panel is mounted between said first rafter and said second rafter of said at least two rafters the portion of the weight of the pane supported by the purlin means is transferred to the first and second rafters through said first and second sub-frames respectively, and any fluid passing over said externally directed surface of said pane to one of said first and second rafters is communicated into said channel of one of said first and second rafters.

2. A curtainwall system as claimed in claim 1, further comprising a rafter sealing means providing a fluid seal interposed between said externally directed surface and said channel to inhibit the communication of fluid into said channel.

3. A curtainwall system as claimed in claim 1, wherein said at least one purlin means of a panel comprises first and second purlins, wherein said first sub-frame and said second sub-frame are arranged generally parallel to each other, and said first and second purlins are arranged normal to said first sub-frame and to said second sub-frame, said first sub-frame and second sub-frame and said first and second purlins providing a generally rectangular framework to support a generally rectangular pane.

4. A curtainwall system as claimed in claim 3 comprising first and second panels, said first and second panels being adapted to be mounted adjacent each other between said first rafter and second rafter of said at least two rafters with the second purlin of the first panel positioned adjacent the first purlin of the second panel and each of said second purlin of said first panel and said first purlin of said second panel having slot forming means to provide opposed slots each adapted to retain an edge of a gasket, whereby a fluid seal may be provided between said adjacent first and second panels along the length of said second purlin of said first panel and said first purlin of said second panel.

5. A curtainwall system as claimed in claim 3 comprising first and second panels, said first and second panels being adapted to be mounted adjacent each other between first and second rafters of said at least two rafters with the second purlin of the first panel positioned adjacent the first purlin of the second panel, and wherein one of said second purlin of said first panel or said first purlin of said second panel has a tongue means extending outwardly along the length thereof, said tongue means being adapted to engage the other of said second purlin of said first panel or said first purlin of said second panel to form a fluid resistant seal between said tongue means and said other purlin, when said first panel and said second panel are mounted adjacent each other between said first and second rafters.

6. A curtainwall system as claimed in claim 5 wherein said tongue means is resiliently deformable.

7. A curtainwall system as claimed in claim 6 wherein said tongue means has a bead extending the length of the tongue means for improving the seal between said adjacent first and second panels.

8. A curtainwall system as claimed in claim 6 wherein said other of said second purlin of said first panel or said first purlin of said second panel has a top flange member and said tongue means of said one purlin abuts said top flange member of said other purlin forming a first fluid seal between said first and second panels.

9. A curtainwall system as claimed in claim 8 wherein said tongue means of said one purlin forms a first purlin channel which is canted toward, and in fluid communication with, at least one channel of one of said first and second rafters.

10. A curtainwall system as claimed in claim 8 wherein said other purlin also has a tongue means extending outwardly along the length thereof, and said tongue means of said other purlin abuts said tongue means of said one purlin along the length thereof, to provide a second fluid seal between said first and second panels.

11. A curtainwall system as claimed in claim 10 wherein said tongue means of said other purlin forms a second purlin channel and said second purlin channel is canted toward, and is in fluid communication with, at least one channel of one of said first and second rafters.

12. A curtainwall as claimed in claim 10 wherein said tongue means of said one purlin is deformed and biased against said upper flange of said other purlin, and said tongue means of said other purlin is deformed and biased against the tongue means of said one purlin, when said first panel is mounted adjacent said second panel between said first and second rafters.

13. A curtainwall system as claimed in claim 1 wherein the sub-frames have base plates and said flange means of said sub-frames depend downwardly from said base plates, and wherein the channels of said first and second rafters have an inner and an outer wall, said outer wall having a bead extending the length thereof, and the base plate of each said sub-frame is orientated and positioned to rest on the bead of said outer wall, whereby a fluid seal is provided interposed between each said base and said outer wall of the channel.

14. A curtainwall system as claimed in claim 1 wherein the sub-frames of a panel have upstanding walls, upper flanges and base plates and said flange means of said sub-frames depend downwardly from said base plates, and wherein the channels of a first rafter and second rafter of said at least two rafters have an inner and an outer wall, said inner wall being adapted and configured to support said upper flange of said first and second sub-frames when a panel is mounted between said first and second rafters.

15. A curtainwall system as claimed in claim 14 further comprising a rafter seal means supported by said inner wall to provide a fluid seal interposed between said upper flange and said inner wall to inhibit the communication of fluid into the channel.

16. A curtainwall system as claimed in claim 15 wherein said rafter seal means comprises an elongated gasket.

17. A structural curtainwall system comprising:

a. first, second and third rafters, said rafters being orientated in spaced apart relation to each other, said first and third rafters having an open channel extending longitudinally along a length of said rafters, said second rafter having first and second open channels extending longitudinally along a length of said second rafter;

b. first and second panels, each panel comprising a pane having a weight and having an externally directed surface, an elongated first sub-frame and an elongated second sub-frame arranged in a spaced apart relation and at least one purlin member interconnecting said each first and second sub-frames, said first sub-frame and said second sub-frame and said at least one purlin member supporting said pane, said first sub-frame and said second sub-frame having a flange means protruding therefrom, wherein said flange means of said first sub-frame of said first panel is oriented and positioned so as to be adapted to be received within the open channel of said first rafter and the flange means of said second sub-frame of said first panel is oriented and positioned to be adapted to be received within one of the first and second channels of said second rafter, and wherein the flange means of said first sub-frame of said second panel is oriented and positioned so as to be adapted to be received within the other of said first and second channels of said second rafter and the flange means of said second sub-frame of said second panel is orientated and positioned so as to be adapted to be received within the channel of said third rafter;

c. means to secure each of said sub-frames to the respective rafters such that each said flange means are received in the respective channels;

said first and second rafters being positioned to support said first and second sub-frames respectively of said first panel such that when said first panel is mounted between said first and second rafters the portion of the weight of the pane of the first panel that is supported by the at least one purlin member of the first panel is transferred to the first and second rafters through said first and second sub-frames of said first panel;

said second and third rafters being positioned to support said first and second sub-frames respectively of said second panel such that when said second panel is mounted between said second and third rafters the portion of the weight of the pane of the second panel that is supported by the at least one purlin member of the second panel is transferred to the second and third rafters through said first and second sub-frames of said second panel, said panels being disposed on opposite sides across said second rafter, and any fluid passing over said externally directed surfaces of said panes of said panels is communicated to one or more of said channels of said rafters.

18. A curtainwall system as claimed in claim 17 wherein the sub-frames of each panel have upstanding walls, upper flanges and base plates and said flange means of said sub-frames depend downwardly from said base plates, and wherein each of the open channels of said first and third rafters have an inner and an outer wall, and said first and second open channels of second rafter each have an outer wall and an inner wall, all said inner walls being adapted and configured to support said upper flanges of said sub-frames when said first and second panels are mounted, and disposed on opposite sides of said second rafter across said second rafter.

19. A curtainwall system as claimed in claim 18 further comprising first, second and third rafter seal means supported by each said inner wall of said first, second and third rafters respectively to provide a fluid seal interposed between each said upper flange and each said inner wall to inhibit the communication of fluid into the channels.

20. A curtainwall system as claimed in claim 19 wherein each of said first, second and third rafter seal means comprises an elongated gasket.

21. A curtainwall system as claimed in claim 17 wherein both said first and second panels have first and second purlins, said first sub-frame and said second sub-frame of each panel are arranged generally parallel to each other, and said first and second purlins of each panel are arranged normal to said first sub-frame and to said second sub-frame of each said panel, said first sub-frame and second sub-frame of each panel and said first and second purlins of each panel providing a generally rectangular framework to support a generally rectangular pane.

22. A curtainwall system as claimed in claim 21 wherein the second sub-frame of said first panel and the first sub-frame of said second panel both have base plates and said flange means of said sub-frames depend downwardly from said base plates, and wherein the channels of said rafters have an inner and an outer wall, said outer wall having a bead extending the length thereof, and the bases of said sub-frames are orientated and positioned to rest on the bead of said outer walls, whereby a fluid seal may be provided between said base and said outer wall of the channel.

23. A curtainwall system as claimed in claim 22 wherein said base plates are oriented generally normal to the channel walls, and wherein both the second sub-frame of said first panel and the first sub-frame of said second panel both have generally upstanding walls extending in a direction generally parallel to said base plates, and a slot forming means extending from each of said upstanding walls forming opposed slots for receiving an edge of a pressure plate, and means to exert a force on said pressure plate toward said rafter when said pressure plate is received in both said slot of said second sub-frame of said first panel and said slot of said first sub-frame of said second panel and said flange means are received in the channels of said second rafter.

24. A curtainwall system as claimed in claim 21 further comprising a sealing means providing a fluid seal interposed between said first and second panels to inhibit the communication of fluid to said channels of said second rafter.

25. A curtainwall system as claimed in claim 24 wherein the second sub-frame of said first panel and the first sub-frame of said second panel both have base plates and said flange means of said sub-frames depend downwardly from said base plates, and wherein the channels of said rafters have an inner and an outer wall, said outer wall having a bead extending the length thereof, and the bases of said sub-frames are oriented and positioned to rest on the bead of said outer walls, whereby a fluid seal may be provided between said base and said outer wall of the channel.

26. A curtainwall system as claimed in claim 25 wherein said base plates are oriented generally normal to the channel walls, and wherein both the second sub-frame of said first panel and the first sub-frame of said second panel both have generally upstanding walls extending in a direction generally parallel to said base plates, and a slot forming means extending from each of said upstanding walls forming opposed slots for receiving an edge of a pressure plate, and means to exert a force on said pressure plate toward said rafter when said pressure plate is received in both said slot of said second sub-frame of said first panel and said slot of said first sub-frame of said second panel and said flange means are received in the channels of said second rafter.

27. A curtainwall system as claimed in claim 26 wherein said sealing means comprises a first seal, said pressure plate and said slots of each said sub-frames co-operating to provide said first seal when said edge of said pressure plate is received within said both said slots and said force means exerts a force on said pressure plate.

28. A curtainwall system comprising;

a. at least two rafters being oriented in spaced apart planar relation to each other;

b. first and second panels, said first and second panels each comprising first and second purlins, said purlins being disposed opposite one another and supporting between them a pane, said panels being adapted to be mounted between a pair of said rafters and said first panel being adapted to be mounted adjacent said second panel with said second purlin of said first panel mounted adjacent said first purlin of said second panel, and wherein both of second purlin of said first panel and said first purlin of said second panel have slot forming means to provide opposed facing slots each adapted to retain an edge of a gasket, whereby a fluid seal is provided between said adjacent first and second panels along the length of said second purlin of said first panel and said first purlin of said second panel.

29. A curtainwall system comprising:

a. at least two rafters being oriented in spaced apart planar relation to each other;

b. first and second panels, said first and second panels each comprising first and second purlins, said purlins being disposed opposite one another and supporting between them a pane, said panels being adapted to be mounted between a pair of said rafters and said first panel being adapted to be mounted adjacent said second panel, and wherein each of said first and second purlins of each of said first and second panels has tongue means extending outwardly the length thereof, said tongue means of the first purlin of said first panel adapted to engage the tongue means of a second purlin of said second adjacent panel to form a fluid resistant seal between said adjacent panels.

30. A panel for use with a pair of rafters, said pair of rafters being orientated in spaced apart relation to each other, each of said rafters having a channel extending longitudinally along a length of said rafters, said panel comprising a pane having a weight and having an externally directed surface, an elongated first sub-frame and an elongated second sub-frame arranged in a spaced apart relation and at least one purlin means interconnecting said first sub-frame and said second sub-frame, said first sub-frame, said second sub-frame and said purlin means supporting said pane, each of said first sub-frame and said second sub-frame having a flange means protruding therefrom, wherein said flange means of said first sub-frame is oriented and positioned so as to be adapted to be received within the channel of one of said rafters and the flange means of said second sub-frame is oriented and positioned so as to be adapted to be received within the channel of another of said rafters, and further comprising a means to secure each said sub-frame to its respective rafter such that each flange means is received in said channels, said one of said rafters and said another of said rafters being positioned to support said first and second sub, frames respectively such that when said panel is mounted between said pair of rafters the portion of the weight of the pane that is supported by the purlin means is transferred to the said one of said rafters and said another of said rafters through said first and second sub-frames respectively, and any fluid passing over said externally directed surface of said pane to one of said pair of rafters is communicated into said channel of one of said pair of rafters.

31. A panel as claimed in claim 30, wherein said purlin means of said panel comprises first and second purlins, wherein said first sub-frame and said second sub-frame are arranged in generally parallel planar relation to each other, and said first and second purlins are arranged generally normal to said first sub-frame and to said second sub-frame, said first sub-frame and second sub-frame and said first and second purlins providing a generally rectangular planar framework to support a generally rectangular planar pane.

32. A panel as claimed in claim 31 wherein one of first and second purlins has a tongue means extending outwardly along the length thereof, said tongue means being adapted to engage a purlin of a second panel to form a fluid resistant seal between said tongue means and said purlin of said second panel, when said panel and said second panel are mounted adjacent each other between said pair of rafters.

* * * * *